US010260130B2

(12) United States Patent
Kawamura et al.

(10) Patent No.: US 10,260,130 B2
(45) Date of Patent: Apr. 16, 2019

(54) MAGNESIUM ALLOY SHEET MATERIAL

(71) Applicants: National University Corporation Kumamoto University, Kumamoto (JP); Kumamoto Technology & Industry Foundation, Kumamoto (JP); Nissan Motor Co., Ltd., Kanagawa (JP)

(72) Inventors: Yoshihito Kawamura, Kumamoto (JP); Masafumi Noda, Kumamoto (JP); Hiroshi Sakurai, Kanagawa (JP)

(73) Assignees: National University Corporation Kumamoto University (JP); Kumamoto Technology & Industry Foundation (JP); Nissan Motor Co., Ltd (JP)

( * ) Notice: Subject to any disclaimer, the term of this patent is extended or adjusted under 35 U.S.C. 154(b) by 499 days.

(21) Appl. No.: 14/657,360

(22) Filed: Mar. 13, 2015

(65) Prior Publication Data

US 2015/0307970 A1 Oct. 29, 2015

Related U.S. Application Data

(62) Division of application No. 13/638,267, filed as application No. PCT/JP2011/058305 on Mar. 31, 2011, now abandoned.

(30) Foreign Application Priority Data

Mar. 31, 2010 (JP) ..... 2010-084516

(51) Int. Cl.
*C22F 1/00* (2006.01)
*C22C 23/06* (2006.01)
(Continued)

(52) U.S. Cl.
CPC ..... *C22C 23/06* (2013.01); *C22C 23/00* (2013.01); *C22C 23/04* (2013.01); *C22C 30/06* (2013.01); *C22F 1/00* (2013.01); *C22F 1/06* (2013.01)

(58) Field of Classification Search
CPC ..... C22C 23/00; C22C 30/06; C22C 23/04; C22C 23/06; C22F 1/00; C22F 1/06
(Continued)

(56) References Cited

U.S. PATENT DOCUMENTS 5,078,807 A * 1/1992 Chang ..... C22F 1/06 148/406
2006/0065332 A1 3/2006 Ienaga et al.
(Continued)

FOREIGN PATENT DOCUMENTS

JP 6-041701 2/1994
JP 2002-256371 9/2002
(Continued)

OTHER PUBLICATIONS

NPL: Yoshimoto et al, Microstructure and mechanical properties of extruded Mg—Zn—Y alloy with 14H long period ordered structure, Materials transactions, vol. 47, No. 4 (2006) pp. 959-965.*

*Primary Examiner* — Jie Yang
(74) *Attorney, Agent, or Firm* — Jordan and Koda, PLLC

(57) ABSTRACT

Disclosed is a magnesium alloy material having excellent tensile strength and favorable ductility. Therefore, the magnesium alloy sheet material formed by rolling a magnesium alloy having a long period stacking order phase crystallized at the time of casting includes in a case where a sheet-thickness traverse section of an alloy structure is observed at a substantially right angle to the longitudinal direction by a scanning electron microscope, a structure mainly composed of the long period stacking order phase, in which, at least two or more αMg phases having thickness in the observed
(Continued)

section of 0.5 μm or less are laminated in a layered manner with the sheet-shape long period stacking order phase.

11 Claims, 21 Drawing Sheets

(51) Int. Cl.

| | |
|---|---|
| ***C22C 23/04*** | (2006.01) |
| ***C22F 1/06*** | (2006.01) |
| ***C22C 23/00*** | (2006.01) |
| ***C22C 30/06*** | (2006.01) |

(58) Field of Classification Search
USPC ..... 148/538
See application file for complete search history.

(56) References Cited

U.S. PATENT DOCUMENTS

| | | | |
|---|---|---|---|
| 2007/0102072 | A1 | 5/2007 | Kawamura et al. |
| 2007/0125464 | A1 | 6/2007 | Kawamura et al. |
| 2007/0169859 | A1 | 7/2007 | Kawamura et al. |
| 2008/0152532 | A1 | 6/2008 | Nakata et al. |
| 2009/0035171 | A1 | 2/2009 | Kawamura et al. |

FOREIGN PATENT DOCUMENTS

| | | |
|---|---|---|
| JP | 2006-097037 | 4/2006 |
| JP | 2008-150704 | 7/2008 |
| JP | 2008-231536 | 10/2008 |
| WO | WO-2006/036033 | 4/2006 |
| WO | WO-2007/111342 | 10/2007 |
| WO | WO-2010/044320 | 4/2010 |

* cited by examiner

FIG.4A
(a)
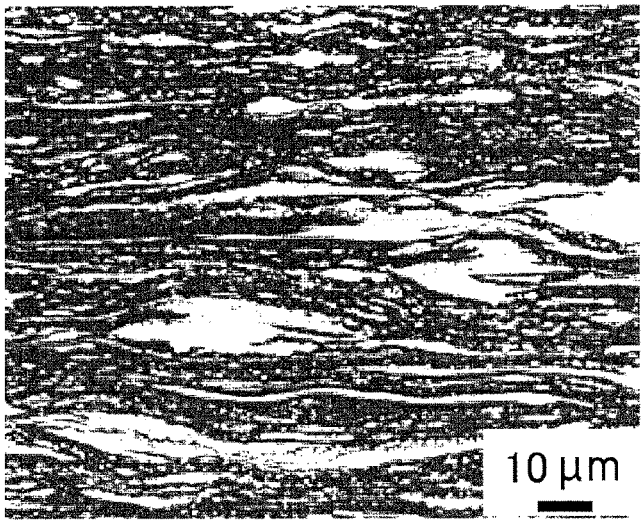
(b)
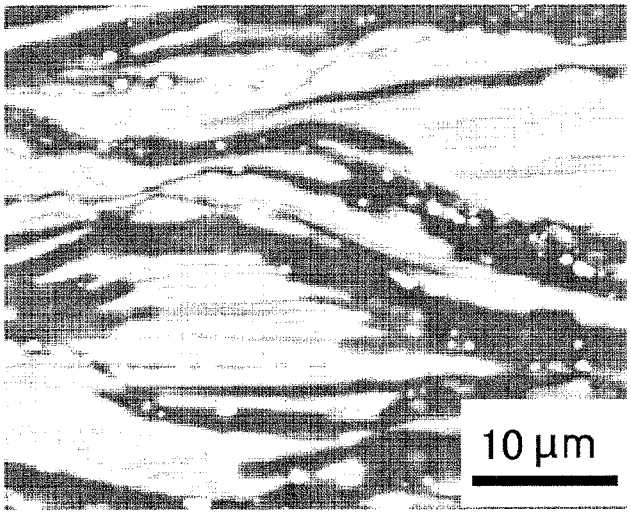
(c)
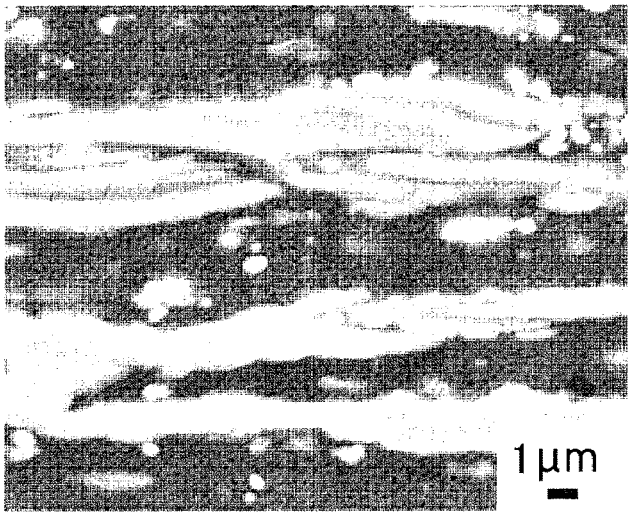

F I G. 6

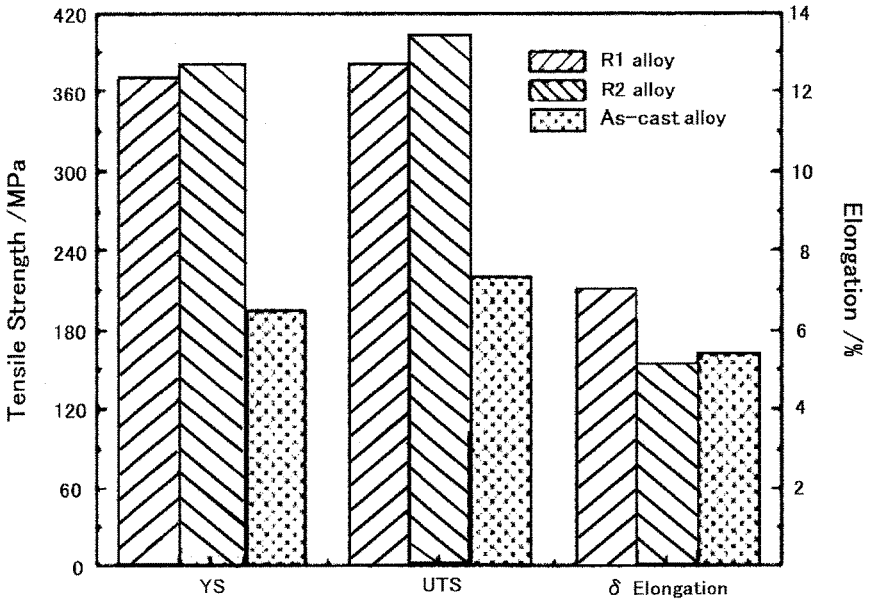

The yield strength, ultimate tensile strength and elongation values of three alloys.

F I G. 7

Table1. Tensile properties of the $Mg_{90.5}Ni_{3.25}Y_{6.25}$ alloy sheet after annealing 673K for 6h

| Alloy | Yield strength $\sigma_Y$(MPa) | Ultimate tensile strength $\sigma_{UTS}$(MPa) | Elongation δ(%) | Density ρ(Mg/m3) |
|---|---|---|---|---|
| $Mg_{90.5}Ni_{3.25}Y_{6.25}$ (at%)alloy (at RT) | 460 | 526 | 8 | 2.09 |
| (at 523K) | 301 | 345 | 12 | |
| (at 573K) | 224 | 236 | 25 | |
| AZ31B (at RT) | 220 | 288 | 15 | 1.78 |
| (at 533K) | 31 | 75 | 75 | |
| HM21XA (at RT) | 172 | 233 | 10 | 1.78 |
| (at 533K) | 103 | 110 | 25 | |
| LA141A (at RT) | 123 | 144 | 23 | 1.35 |
| WE54A-T6 (at RT) | 200 | 275 | 5 | 1.85 |
| (at 523K) | 170 | 225 | 7.5 | |

Commercial Mg sheets AZ31B, HM21XA and LA141A are shown for comparison.WE54(a typical high-tempera ture-resista nt Mg cast alloy)is also listed.

FIG. 7

Table 1. Tensile properties of the $Mg_{90.5}Ni_{3.25}Y_{6.25}$ alloy sheet after annealing 673K for 6h

| Alloy | Yield strength $\sigma_y$(MPa) | Ultimate tensile strength $\sigma_{UTS}$(MPa) | Elongation δ(%) | Density ρ(Mg/m3) |
|---|---|---|---|---|
| $Mg_{90.5}Ni_{3.35}Y_{6.25}$ (at%) alloy (at RT) | 460 | 526 | 8 | 2.09 |
| (at 523K) | 301 | 345 | 12 | |
| (at 573K) | 224 | 236 | 25 | |
| AZ31B (at RT) | 220 | 288 | 15 | 1.78 |
| (at 533K) | 31 | 75 | 75 | |
| HM21XA (at RT) | 172 | 233 | 10 | 1.78 |
| (at 533K) | 103 | 110 | 25 | |
| LA141A (at RT) | 123 | 144 | 23 | 1.35 |
| WE54A-T6 (at RT) | 200 | 275 | 5 | 1.35 |
| (at 523K) | 170 | 225 | 7.5 | |

Commercial Mg sheets AZ31B, HM21XA and LA141A are shown for comparison WE54 (a typical high-temperature-resistant Mg cast alloy) is also listed.

MAGNESIUM ALLOY SHEET MATERIAL

This is a Divisional application of U.S. Ser. No. 13/638,267, filed Dec. 10, 2012.

TECHNICAL FIELD

The present invention relates to a magnesium alloy sheet material. In detail, the present invention relates to a magnesium alloy sheet material having high tensile strength and high ductility.

BACKGROUND ART

In general, a magnesium alloy has the lowest density and the lightest weight and also has high tensile strength among practically utilized alloys. Thus, magnesium alloy is increasingly applied to a casing of an electric product, a wheel, a suspension, and parts around an engine of an automobile, and the like.

Particularly, high mechanical properties are required for parts used in relation to automobiles. Thus, as a magnesium alloy to which elements such as Gd and Zn are added, a material of a specific form is manufactured by a single roll method and a rapid solidification method (for example, refer to Patent Document 1 and Patent Document 2).

However, regarding the magnesium alloy described above, although high mechanical properties are obtained with a specific manufacturing method, there is a problem that special facilities are required in order to realize the specific manufacturing method and moreover, productivity is low. Furthermore, there is a problem that applicable members are limited.

Conventionally, there is a proposed technique that in a case of manufacturing a magnesium alloy, even when highly-productive normal melting and casting and then plastic working (extrusion) are performed without using the special facilities or processes as described in Patent Document 1 and Patent Document 2 above, practically useful mechanical properties are obtained (for example, refer to Patent Document 3).

CITATION LIST

Patent Document

Patent Document 1: Japanese Published Unexamined Patent Application No. H6-41701

Patent Document 2: Japanese Published Unexamined Patent Application No. 2002-256370

Patent Document 3: Japanese Published Unexamined Patent Application No. 2006-97037

SUMMARY OF THE INVENTION

A magnesium alloy having a long period stacking order phase (hereinafter, referred to as the "LPSO" phase) disclosed in Patent Document 3 is excellent in balance between tensile strength and ductility. Although a cast material does not have very high tensile strength, by performing plastic working such as extrusion, improvement in tensile strength can be realized without lowering ductility very much. That is, even when plastic working of a large working ratio such as extrusion is performed, sufficient ductility can be obtained.

However, when tensile strength is to be improved with plastic working at the time of manufacturing a sheet material or a rod material as a material, ductility is consequently lowered.

For example, FIG. 6 shows yield strength, tensile strength, and elongation of a cast material of a $Mg_{96}ZnY_3$ alloy and hot-rolled materials (R1, R2). It is found that the hot-rolled material (R2) has higher yield strength and higher tensile strength but smaller elongation than the hot-rolled material (R1). It should be noted that FIG. 6 is described in Non-patent Document (R. G. Li, D. Q. Fang, J. An, Y. Lu, Z. Y. Cao, Y. B. Liu, MATERIALS CHARACTERIZATION 60 (2009) 470-475).

FIG. 7 shows mechanical properties of various materials. When the mechanical properties of the same alloys of different processes are compared, it is found that alloys realizing high yield strength and high tensile strength have small elongation. It should be noted that FIG. 7 is described in Non-patent Document (T. Itoi et al./Scripta Materialia 59 (2008) 1155-1158).

As described above, both the characteristics of tensile strength and ductility are not easily improved at the same time.

The present invention has been made in view of these circumstances, and an object thereof is to provide a magnesium alloy sheet material capable of realizing improvement in tensile strength and at the same time, also realizing improvement in ductility.

In order to achieve the above object, a magnesium alloy sheet material of the present invention is a magnesium alloy sheet material formed by rolling a magnesium alloy having a long period stacking order phase crystallized at the time of casting, including, in a case where a sheet thickness traverse section of an alloy structure is observed at a substantially right angle to the longitudinal direction by a scanning electron microscope, a structure mainly composed of the long period stacking order phase, in which at least two or more αMg phases having thickness in the observed section of 0.5 μm or less are laminated in a layered manner with the sheet-shape long period stacking order phase.

Here, in a case where the sheet-thickness traverse section of the alloy structure is observed at a substantially right angle to the longitudinal direction by the scanning electron microscope, the structure mainly composed of the long period stacking order phase, in which, at least two or more αMg phases having thickness in the observed section of 0.5 μm or less are laminated in a layered, manner with the sheet-shape long period stacking order phase is provided, improvement in tensile strength can be realized and at the same time, improvement in ductility can also be realized, so that excellent tensile strength and favorable ductility can be realized.

That is, the LPSO phase is formed in a sheet shape (plate shape). Thus, when comparing with a case where the LPSO phase is formed in a block shape, at least part of the LPSO phase is brought into a structure state that the part is easily shear-deformed or compression-deformed in accordance with rolling. In addition, since at least part of the LPSO phase is in the structure state that the part is easily shear-deformed or compression-deformed, a kink band is easily introduced into the LPSO phase, and as a result, excellent tensile strength can be realized. In addition, since at least part of the LPSO phase is in the structure state that the part is easily shear-deformed or compression-deformed, favorable ductility can also be realized.

In a case where maximum sheet thickness of the LPSO phase in the laminated structure is 9 μm or less, generally 10% or more elongation can be realized.

Furthermore, in a case where the laminated structure (specifically, the LPSO phase or the αMg phases) includes an intermetallic compound (such as $Mg_3Zn_3Y_2$), the structure state is such that the intermetallic compound is sandwiched by the sheet-shape (plate-shape) LPSO phase. Since the intermetallic compound easily facilitates deformation of the LPSO phase, such a structure state is a state that the LPSO phase is easily deformed. Therefore, the kink band is easily introduced into the LPSO phase, so that excellent tensile strength can be realized.

When at least part of the laminated structure is shear-deformed or compression-deformed, at least part of the laminated structure is curved or bent. Such a curved or bent structure can be a cause for realizing excellent tensile strength.

Here, the "sheet-shape LPSO phase in a case where the sheet-thickness traverse section of the alloy structure is observed at a substantially right angle to the longitudinal direction by the scanning electron microscope" indicates a structure as shown in FIG. 8, for example. A light gray point in FIG. 8 indicates the LPSO phase. It should be noted that FIG. 8(*a*) is a scanning electron micrograph of a magnificent ion of 150×, FIG. 8(*b*) is a scanning electron micrograph of a magnification of 2,500×, and FIG. 8(*c*) is a scanning electron micrograph of a magnification of 3,000×.

The "sheet-thickness traverse section" indicates a section whose thickness is reduced by rolling, the section which is substantially parallel to the forward direction of the sheet material at the time of rolling (section at a substantially right angle to a mill roll). Furthermore, the "longitudinal direction of the sheet-thickness traverse section" indicates the direction which is substantially parallel to the forward direction of the sheet, material at the time of rolling (direction at a substantially right angle to the rolling roll). The "substantially right angle to the longitudinal direction of the sheet-thickness traverse section" indicates the thickness direction of the sheet-thickness traverse section.

That is, the "sheet-thickness traverse section is observed at a substantially right angle to the longitudinal direction" indicates that the "'section whose thickness is reduced by rolling, the section which is substantially parallel to the forward direction of the sheet material at the time of rolling' is observed in the 'thickness direction of the section' at the substantially right angle to the 'direction which is substantially parallel to the forward direction of the sheet material at the time of rolling.'"

The "magnesium alloy in which the LPSO phase is crystallized at the time of casting" includes Mg—Zn—RE (RE=Y, Dy, Ho, Er, Tm), Mg—Cu—RE (RE=Y, Gd, Tb, By, Ho, Er, Tm), Mg—Ni—RE (RE=Y, Sm, Gd, Tb, Dy, Ho, Er), Mg—Co—RE (RE=Y, Dy, Ho, Er, Tm), and Mg—Al—Gd. It should be noted that RE indicates a rare-earth element.

Furthermore, the "magnesium alloy in which the LPSO phase is crystallized at the time of casting" is not necessarily limited, to a three-component system as exemplified above but may be a four-component system in which another additive element is added to the magnesium alloy described above or a larger component system.

Effects of the Invention

With the magnesium alloy sheet material of the present invention, the improvement in tensile strength can be realized and at the same time, the improvement in ductility can also be realized.

BRIEF DESCRIPTION OF THE DRAWINGS

FIG. 1A(b) is a micrograph (2) showing the crystalline structure of the $Mg_{96}Zn_2Y_2$ alloy serving as the magnesium alloy sheet material of the present invention;

FIG. 1A(c) is a micrograph (3) showing the crystalline structure of the $Mg_{96}Zn_2Y_2$ alloy serving as the magnesium alloy sheet material of the present invention;

FIG. 1B(b) is a micrograph (5) showing the crystalline structure of the $Mg_{96}Zn_2Y_2$ alloy serving as the magnesium alloy sheet material of the present invention;

FIG. 1B(c) is a micrograph (6) showing the crystalline structure of the $Mg_{96}Zn_2Y_2$ alloy serving as the magnesium alloy sheet material of the present invention;

FIG. 4A is a micrograph (1) showing a crystalline structure of the magnesium alloy material formed by performing rolling S4 on a plastically-worked, item to which no heating step is performed;

FIG. 4B(b) is a micrograph (3) showing the crystalline structure of the magnesium alloy material formed by performing the rolling S4 on the plastically-worked item to which no heating step is performed;

FIG. 4B(c) is a micrograph (4) showing the crystalline structure of the magnesium alloy material formed by performing the rolling S4 on the plastically-worked item to which no heating step is performed;

FIG. 6 is a graph showing yield strength, tensile strength, and elongation of a cast material of a $Mg_{96}ZnY_3$ alloy and hot-rolled materials (R1, R2);

FIG. 7 is a table showing mechanical properties of various materials;

FIG. 8(*b*) is a micrograph (2) for illustrating one example of the sheet-shape structure;

FIG. 8(*c*) is a micrograph (3) for illustrating one example of the sheet-shape structure;

FIG. 10(*b*) is a diagram (2) for illustrating the relationship between the maximum thickness of the LPSO phase in the lamellar structure and elongation of the magnesium alloy sheet material;

FIG. 11A(b) is a scanning electron micrograph (2) of the magnesium alloy sheet material formed by rolling the excessively heated material;

FIG. 11B(b) is a scanning electron micrograph (4) of the magnesium alloy sheet material formed by rolling the excessively heated material.

DESCRIPTION OF THE PREFERRED EMBODIMENTS

Hereinafter, an embodiment of the present invention will be described with reference to the drawings for understanding of the present invention.

Figure 1A:
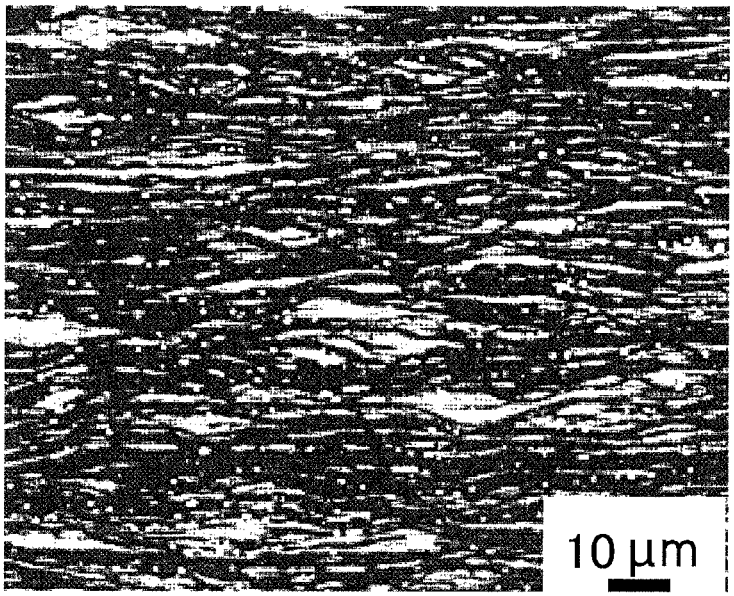
FIG. 1A(a) is a micrograph (1) showing a crystalline structure of a $Mg_{96}Zn_2Y_2$ alloy serving as a magnesium alloy sheet material of the present invention.
Figure 1A:
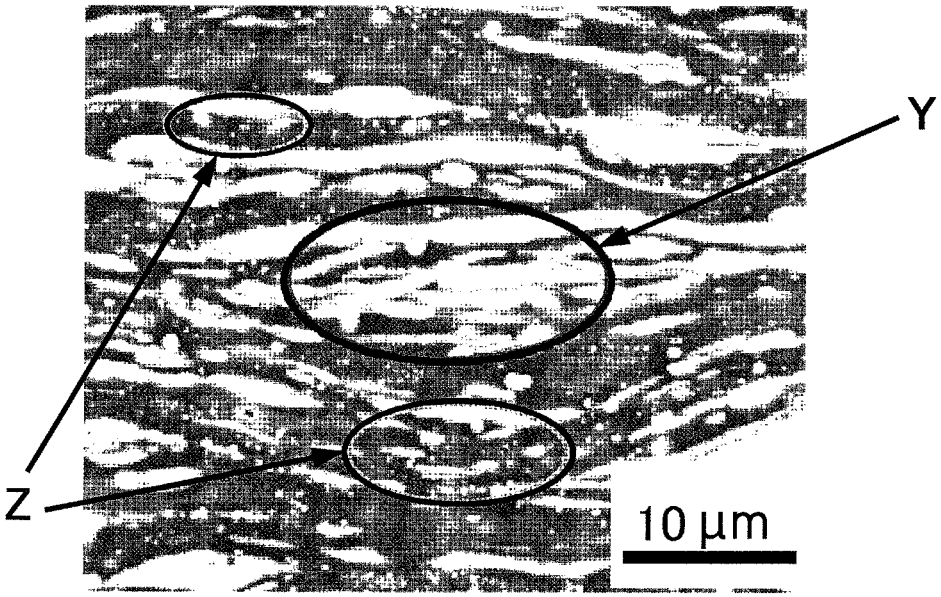
Figure 1A:
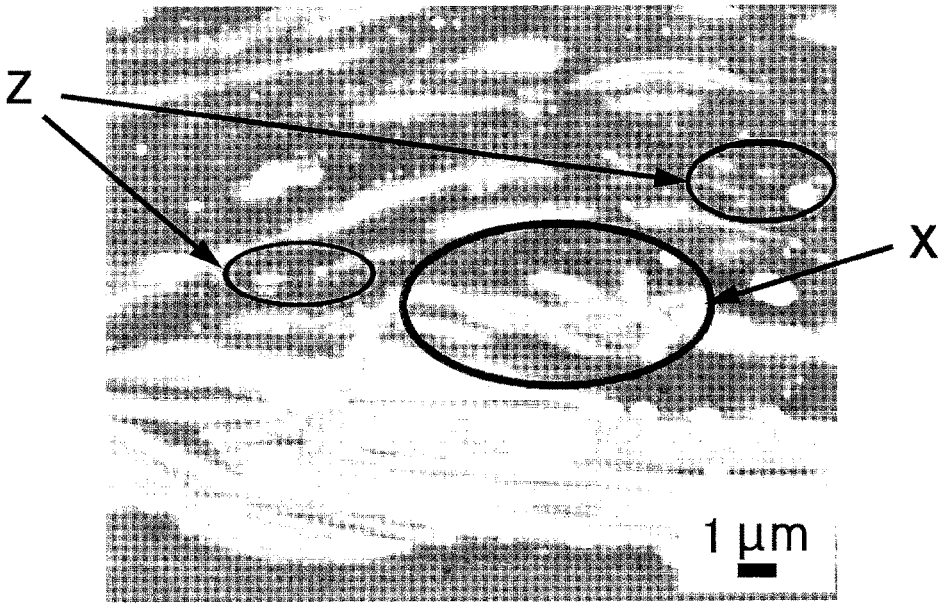
Figure 1B:
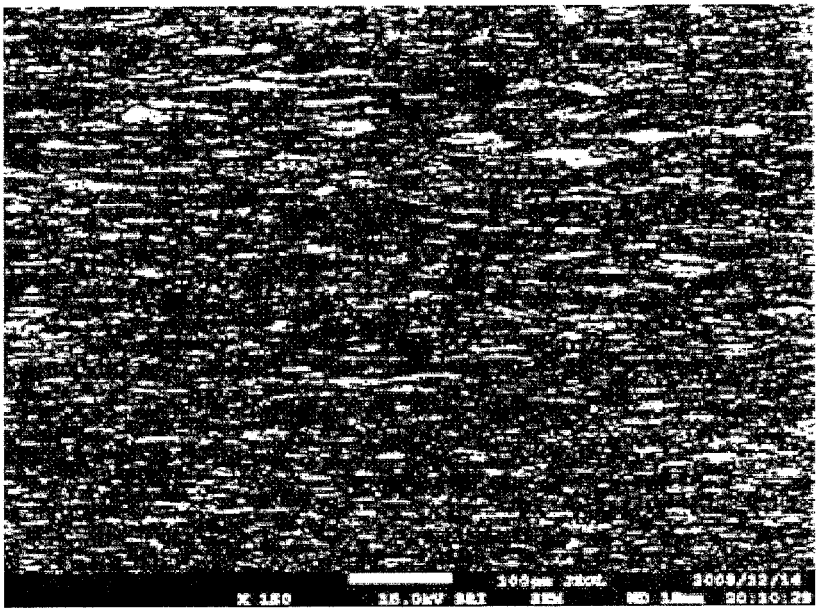
FIG. 1B(a) is a micrograph (4) showing the crystalline structure of the $Mg_{96}Zn_2Y_2$ alloy serving as the magnesium alloy sheet material of the present invention.
Figure 1B:
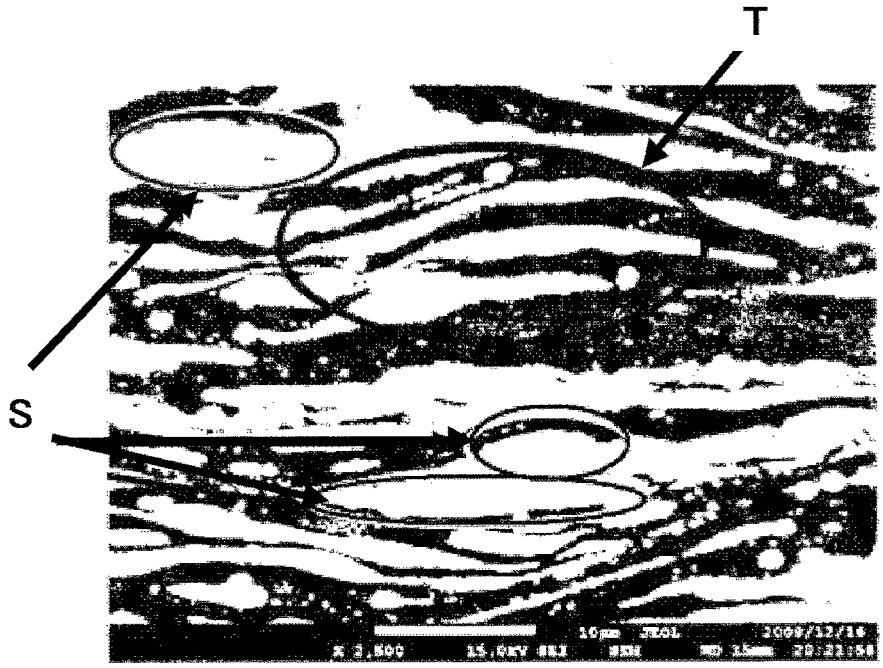
Figure 1B:
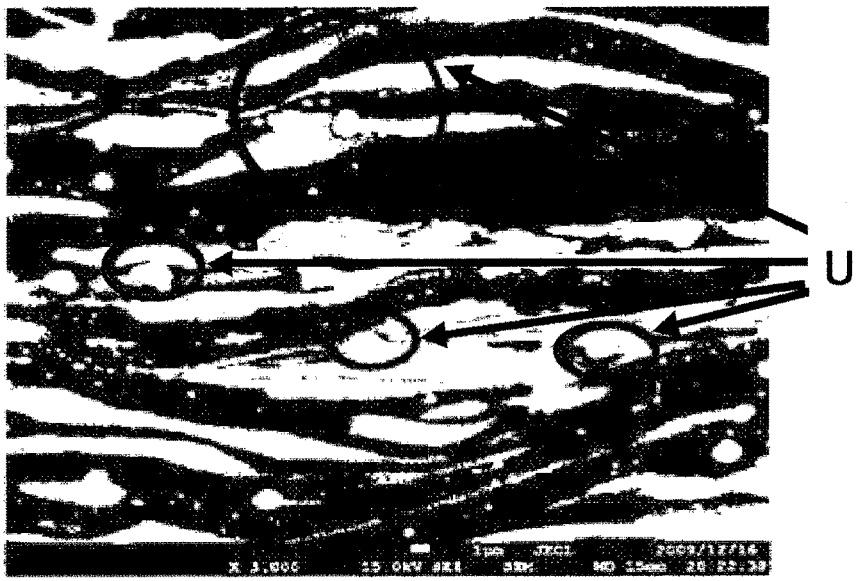

FIGS. 1A and 1B are scanning electron micrographs showing a crystalline structure of a $Mg_{96}Zn_2Y_2$ alloy serving as a magnesium alloy sheet material of the present invention. In FIGS. 1A and 1B, a αMg phase is black, an LPSO phase is gray, and a $Mg_3Zn_3Y_2$ is white.

It should be noted that in the present embodiment, description will be given taking the $Mg_{96}Zn_2Y_2$ alloy as an example. However, the present invention is not limited to such an alloy composition. For example, another three-component system or a four-component system in which another additive element is added may be adopted.

As clear from FIGS. 1A and 1B, the magnesium alloy sheet material to which the present invention is applied has an LPSO phase and αMg phases, and the LPSO phase and the αMg phases are formed in a lamellar manner. However, not all the structures are lamellar structures but a region shown by reference sign X in FIG. 1A(c) is not the lamellar structure.

It should be noted that the LPSO phase is a precipitate precipitated in a grain and a grain boundary of a magnesium alloy, which is a structural phase that sequence of bottom surface atomic layers in an HCP structure is repeated in the bottom surface normal direction with a long period order, that is, a long period stacking order phase. By precipitation of this LPSO phase, mechanical properties of the magnesium alloy sheet material (tensile strength, 0.2% yield strength, and elongation) are improved.

The LPSO phase has a sheet-shape (plate-shape) structure (regions shown by reference sign S in FIG. 1B(b)). The αMg phase is placed in a gap between the sheet-shape (plate-shape) structure. That is, the sheet-shape (plate-shape) structure is laminated as multiple layers in the LPSO phase.

Specifically, the lamellar structure described above in the magnesium alloy sheet material to which the present invention is applied (refer to reference sign S in FIG. 1B(b) is mainly composed of the LPSO phase, and in a case where a sheet-thickness traverse section is observed at a substantially right angle to the longitudinal direction by a scanning electron microscope, the plurality of αMg phases having thickness in the observed section of 0.5 μm or less and the sheet-shape (plate-shape) LPSO phase are laminated in a layered manner. It should be noted that in a case where the sheet-thickness traverse section is observed at a substantially right angle to the longitudinal direction by the scanning electron microscope, the sheet-shape (plate-shape) LPSO phase has thickness of 0.25 μm or more in the observed section.

Regarding the lamellar structure described above (refer to reference sign S in FIG. 1B(b)), by appropriately heating a material thereof (such as an extrusion material) before rolling, the structure of the LPSO phase can be controlled to have a desired sheet shape (plate shape).

Figure 9:
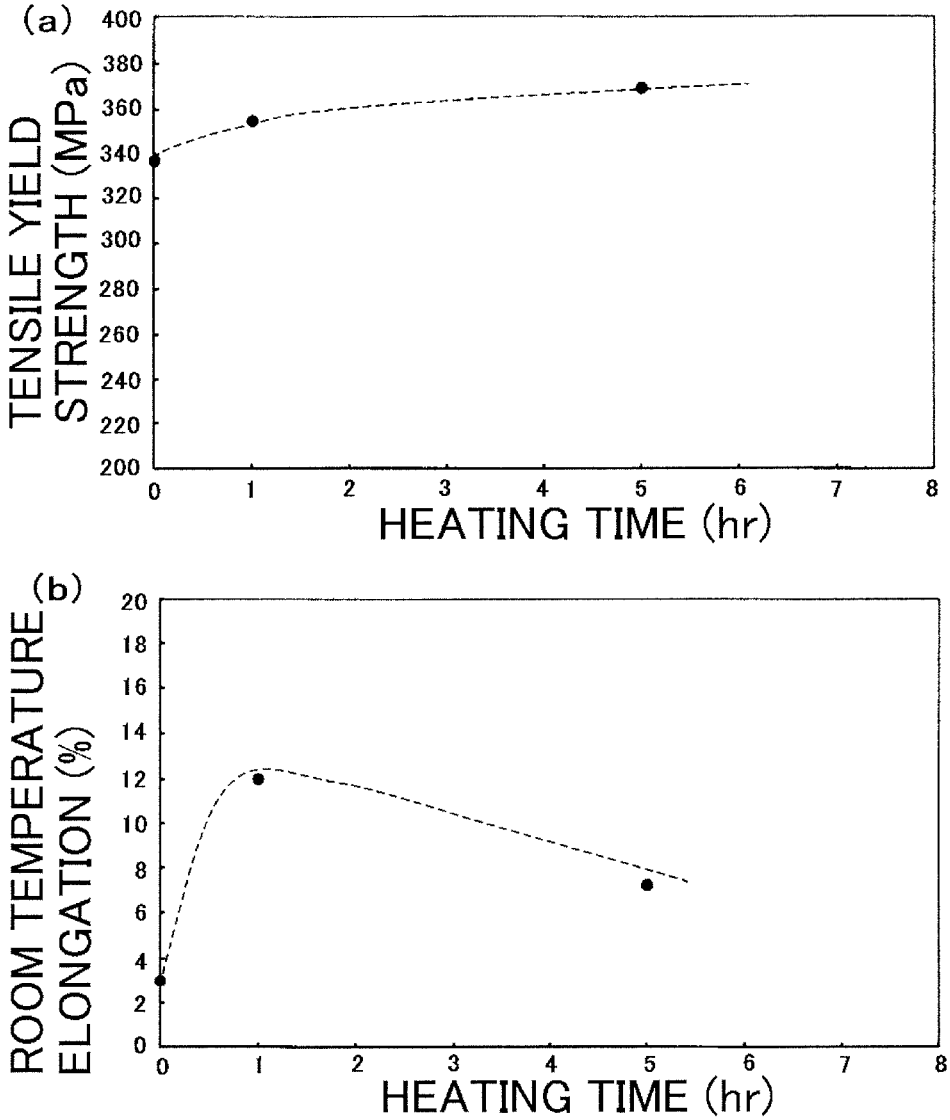
FIG. 9 is a graph showing a relationship between a heating time and tensile yield strength and a relationship between the heating time and room temperature elongation.

FIG. 9(*a*) shows a "relationship between a heating time and tensile yield strength," and FIG. 9(*b*) shows a "relationship between the heating time and room temperature elongation." It should be noted that a heating temperature is 480° C. As clear from the "relationship between the heating time and the room temperature elongation" shown in FIG. 9(*b*), the elongation is not improved by simply heating but there is a need for appropriately heading in such a manner that a thin sheet material after rolling can realize large elongation.

Figure 10:
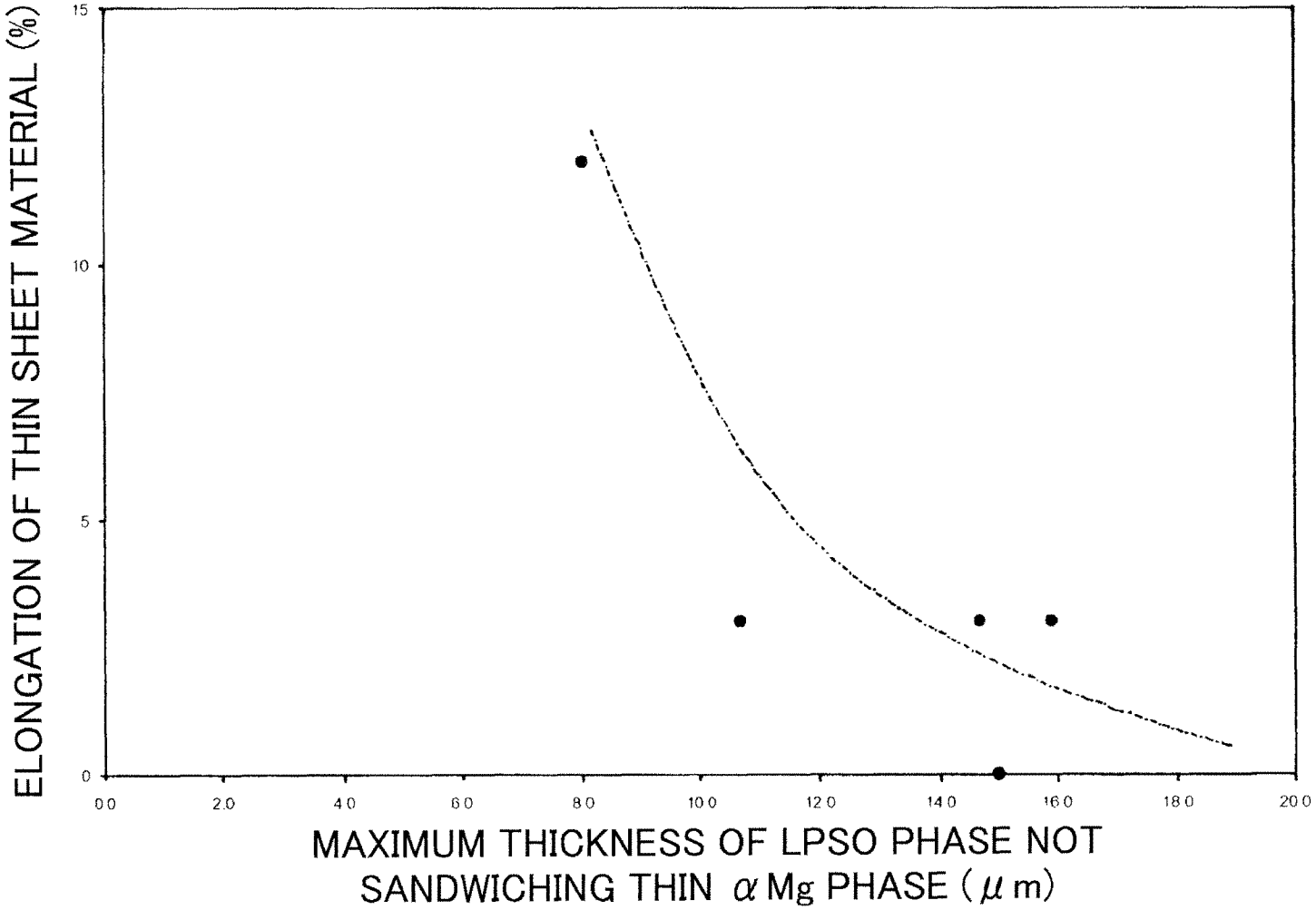
FIG. 10(*a*) is a diagram (1) for illustrating a relationship between maximum thickness of an LPSO phase in a lamellar structure and elongation of the magnesium alloy sheet material.
Figure 10:
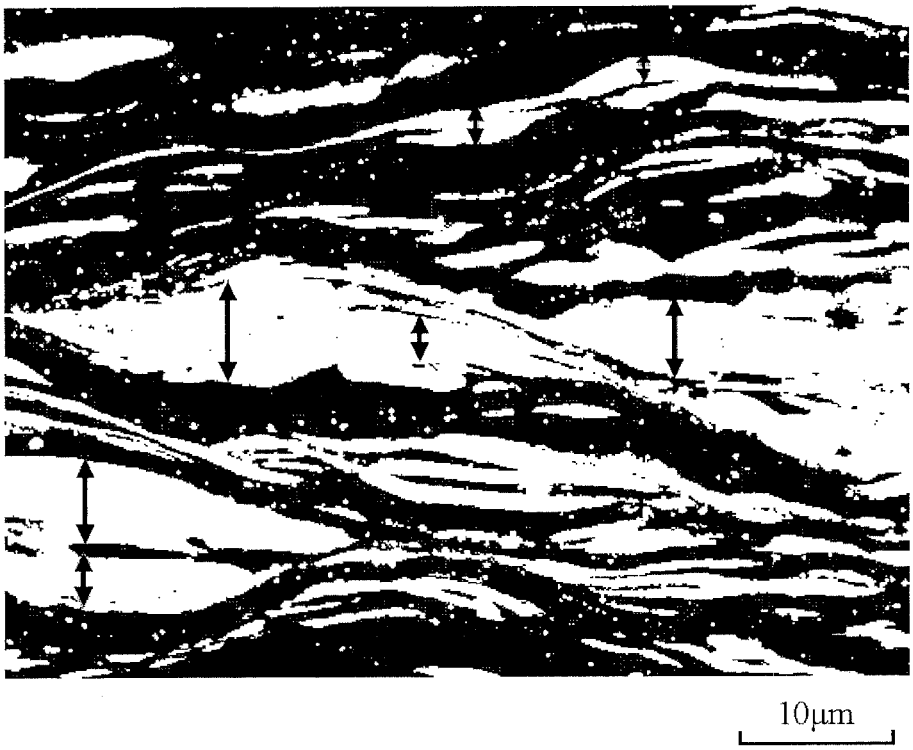

FIG. 10(*a*) shows a "relationship between maximum thickness of the LPSO phase in the lamellar structure and elongation of the magnesium alloy sheet material." As clear from FIG. 10(*a*), in a case where the structure is refined so that the maximum thickness in the observed section of the LPSO phase in the lamellar structure is 9 μm or less, generally 10% or more elongation can be obtained.

That is, by appropriately heating before rolling, it is extremely important technically that the maximum thickness in the observed section of the LPSO phase in the lamellar structure after rolling is 9 μm or less.

It should be noted that the "thickness in the observed section of the LPSO phase" indicates length in the perpendicular direction to the longitudinal direction of the sheet-shape (plate-shape) LPSO phase (direction of arrow shown in FIG. 10(*b*)).

A heating condition before rolling is appropriately selected. Then, even, with the structure in which the thickness in the observed section of the LPSO phase in the lamellar structure looks large, in a case where confirmation is performed with a magnification of the scanning electron microscope being increased, the αMg phases of thin films of 0.1 μm or less than 0.1 μm form a laminated structure together with the LPSO phase. That is, a multilayer structure in which the LPSO phase of a thin film and the αMg phases having smaller thickness in the observed section than the LPSO phase are laminated can be confirmed.

Meanwhile, by insufficient heating, the sheet-shape (plate-shape) LPSO phase cannot sufficiently be formed. By excessive heating such as a long heating time, the thickness in the observed section of the sheet-shape (plate-shape) LPSO phase is increased, so that a formation frequency of the layer structure with the thin αMg phases is lowered (refer to FIGS. 11A and 11B).

Figure 11A:
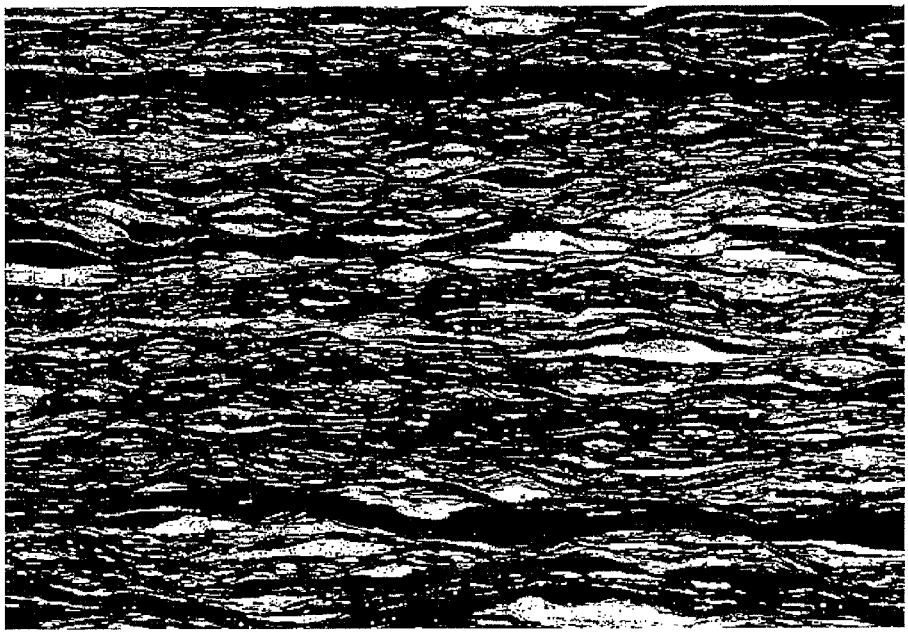
FIG. 11A(a) is a scanning electron micrograph (1) of the magnesium, alloy sheet material formed by rolling an excessively heated material.
Figure 11A:
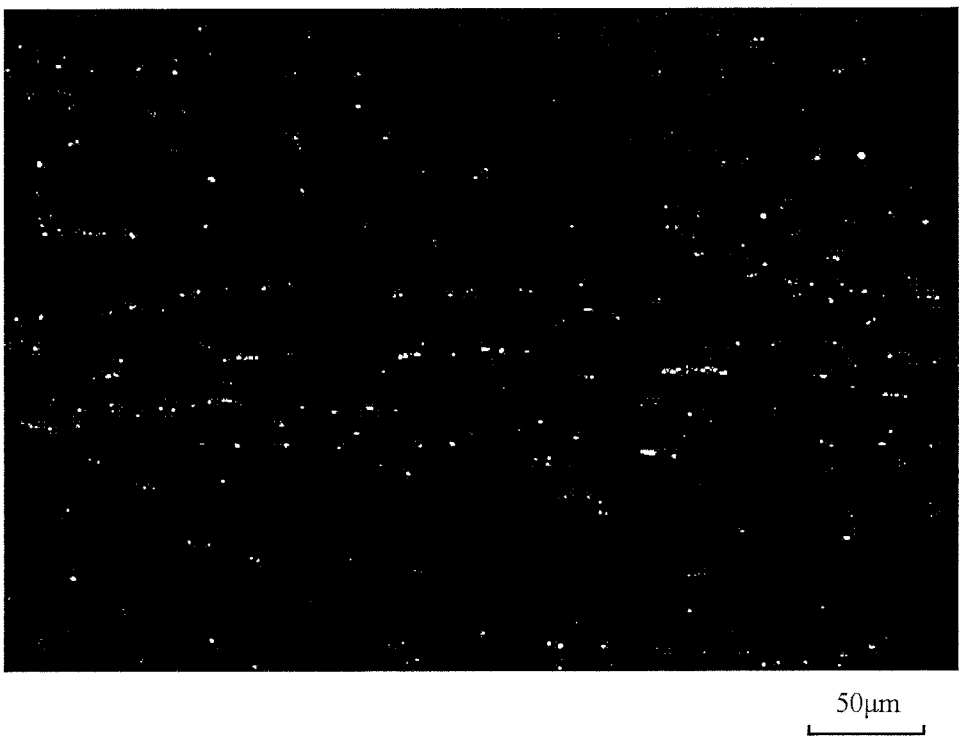
Figure 11B:
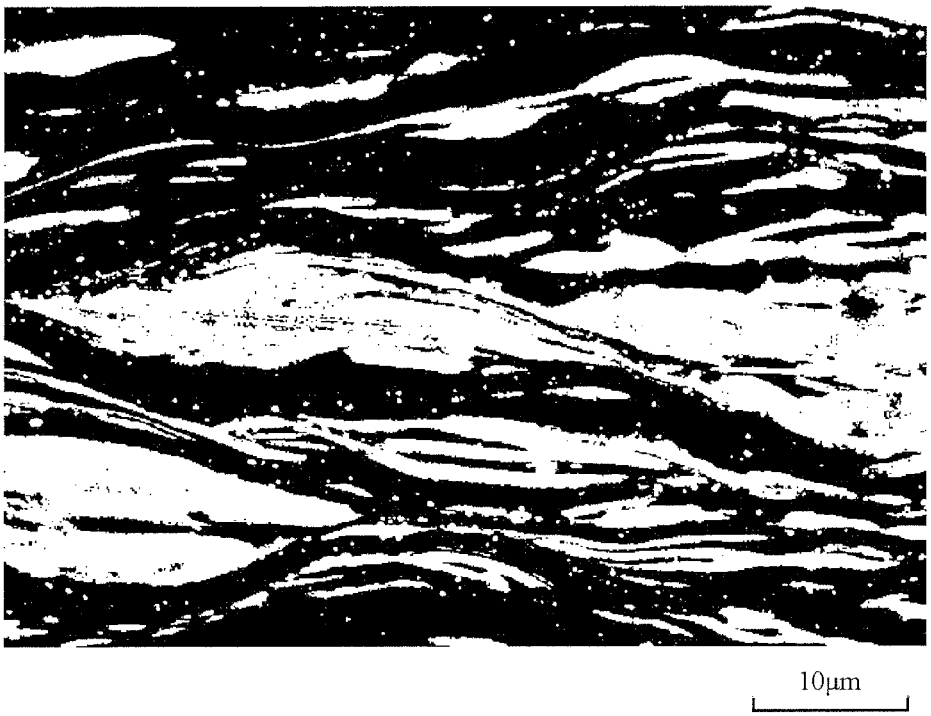
FIG. 11B(a) is a scanning electron micrograph (3) of the magnesium alloy sheet material formed by rolling the excessively heated material.
Figure 11B:
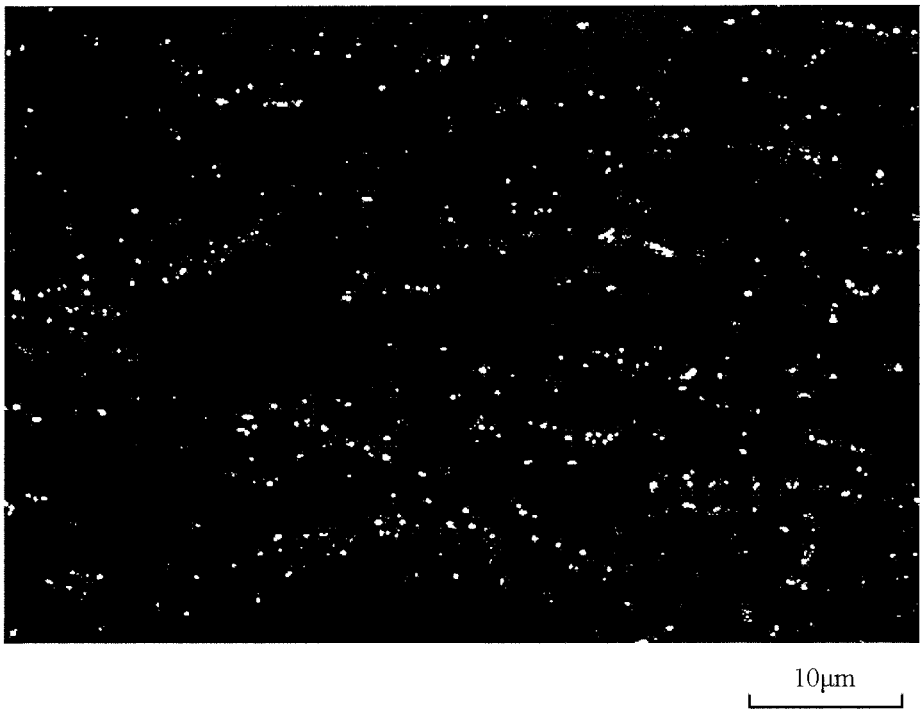

FIGS. 11A and 11B show scanning electron micrographs of the magnesium alloy sheet material formed by rolling an excessively heated material. It should be noted that in order to improve convenience in visual recognition, FIGS. 11A(a) and 11B(a) show states in which a contrast of the LPSO phase, is enhanced and FIGS. 11A(b) and 11B(b) show states in which a contrast of the compound is enhanced.

In the magnesium alloy sheet material to which the present invention is applied, by appropriately heating the material thereof before rolling as in a manufacturing method described below, the structure is controlled so that the thickness in the observed section of the LPSO phase in the lamellar structure, in other words, the thickness in the observed section of the LPSO phase not sandwiching the αMg phase of a thin film of 0.5 μm or less is 8 μm at maximum.

The LPSO phase has the sheet-shape (plate-shape) structure. Thus, when comparing with an LPSO phase having a block shape structure, at least part of the LPSO phase is easily shear-deformed or compression-deformed in accordance with rolling. It should be noted that the fact that at least part of the LPSO phase is easily shear-deformed or compression-deformed in accordance with rolling is clear from the fact that part of the lamellar structure of the LPSO phase and αMg phases is curved or bent as described below.

Since at least part of the LPSO phase is in a structure state that the part is easily shear-deformed or compression-deformed in accordance with rolling, a kink band is easily introduced into the LPSO phase as a result, so that excellent tensile strength can be realized. Since at least part of the LPSO phase is in the structure state that the part is easily shear-deformed or compression-deformed in accordance with rolling, favorable ductility can also be realized.

It should be noted that the LPSO phase not only has the sheet-shape (plate-shape) structure but also sometimes has a block-shape structure as in a region shown by reference sign Y in FIG. 1A(b), for example. That is, a structure shape, of the LPSO phase is a sheet shape (plate-shape) or a mixture of a sheet shape (plate-shape) and a block shape.

It is found that in both the LPSO phase and the αMg phases of the lamellar structure, the structure is totally curved. This is thought to be because the structure or part of the structure is curved or bent due to shear-deformation or compression-deformation of the sheet-shape, (plate-shape) LPSO phase and the αMg phases sandwiched by such a sheet-shape (plate-shape) LPSO phase (region shown by reference sign T in FIG. 1B(b)). It should be noted that curving or bending of the lamellar structure can be a cause for realizing excellent tensile strength.

Furthermore, $Mg_3Zn_3Y_2$ is minutely spread in the LPSO phase or the αMg phases (regions shown by reference sign Z in FIGS. 1A(b) and 1A(c) and regions shown by reference sign T and reference sign U in FIG. 1B(c)).

The intermetallic compound $Mg_3Zn_3Y_2$ is in a structure state that the compound is sandwiched by the LPSO phase. The LPSO phase has the sheet-shape (plate-shape) structure. Therefore, the intermetallic compound $Mg_3Zn_3Y_2$ facilitates deformation of the LPSO phase. Thus, as a result of facilitation of the deformation of the LPSO phase, the kink band is easily introduced into the LPSO phase, so that excellent tensile strength can be realized.

As described above, in the magnesium alloy sheet material of the present invention, the LPSO phase has the sheet-shape (plate-shape) structure and is in the structure state that the LPSO phase is easily shear-deformed or compression-deformed in accordance with rolling, and the intermetallic compound $Mg_3Zn_3Y_2$ facilitates the deformation of the LPSO phase. Thus, improvement in tensile strength can be realized and at the same time, improvement in ductility can also be realized.

In the magnesium alloy sheet material of the present invention, the LPSO phase is minutely spread by appropriate heating in order to obtain large elongation, and without destroying the LPSO phase by strong shear-deformation or compression-deformation by rolling serving as the following step, distortion, that is, kink deformation is effectively given to the LPSO phase. Thus, a reinforcing mechanism of the LPSO phase can sufficiently be activated. Therefore, the magnesium alloy sheet material with the same working ratio of rolling but having larger elongation can be obtained.

Hereinafter, the manufacturing method of the magnesium alloy sheet material of the present invention will be described.

Figure 2:
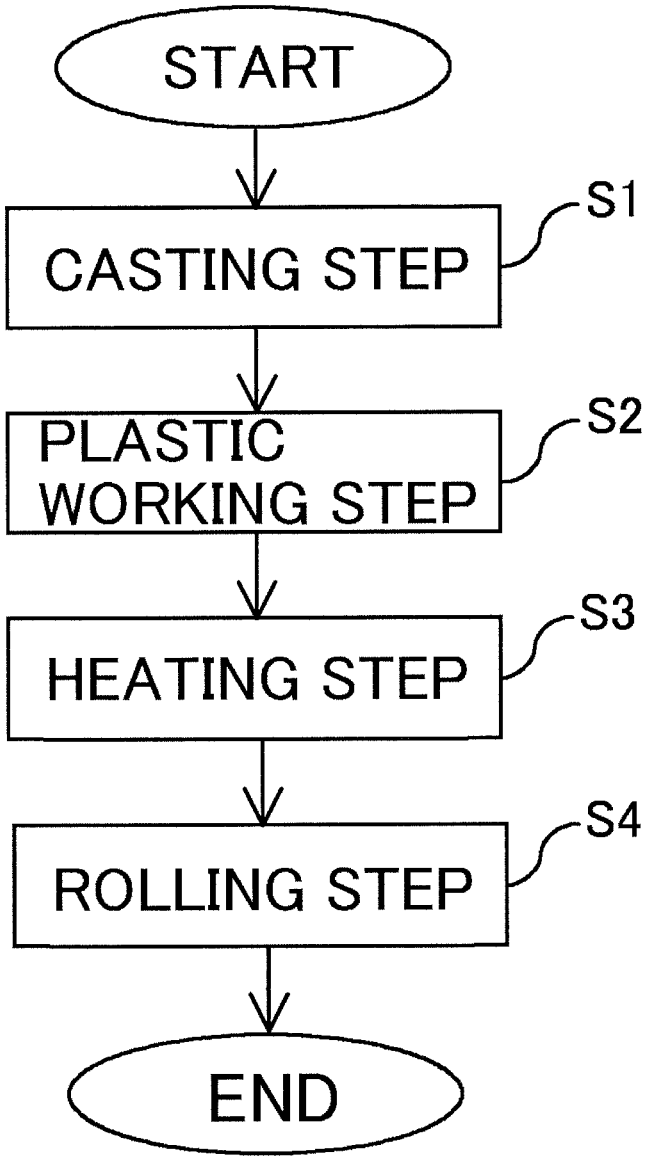
FIG. 2 is a flowchart for illustrating a manufacturing method of the magnesium alloy sheet material.

FIG. 2 is a flowchart for illustrating the manufacturing method of the magnesium alloy sheet material of the present invention. As shown in FIG. 2, in the manufacturing method of the magnesium alloy sheet material of the present invention, casting is first performed in a casting step S1. In the casting step S1, a Mg—Sn—Y alloy containing Zn and Y, and the remaining part including Mg and unavoidable impurities is cast, so as to form a cast material containing the LPSO phase and the αMg phases.

It should be noted that a forming method of the cast material may be any method such as a method of high-frequency induction melting in an Ar gas atmosphere (refer to Example 1 of International Publication No. 2007/111342) and a method, for melting a magnesium alloy while making a $CO_2$ gas flow into an iron crucible using an electric furnace, and charging the alloy into an iron casting mold (refer to Example 3 of International Publication No. 2007/111342).

Figure 3:
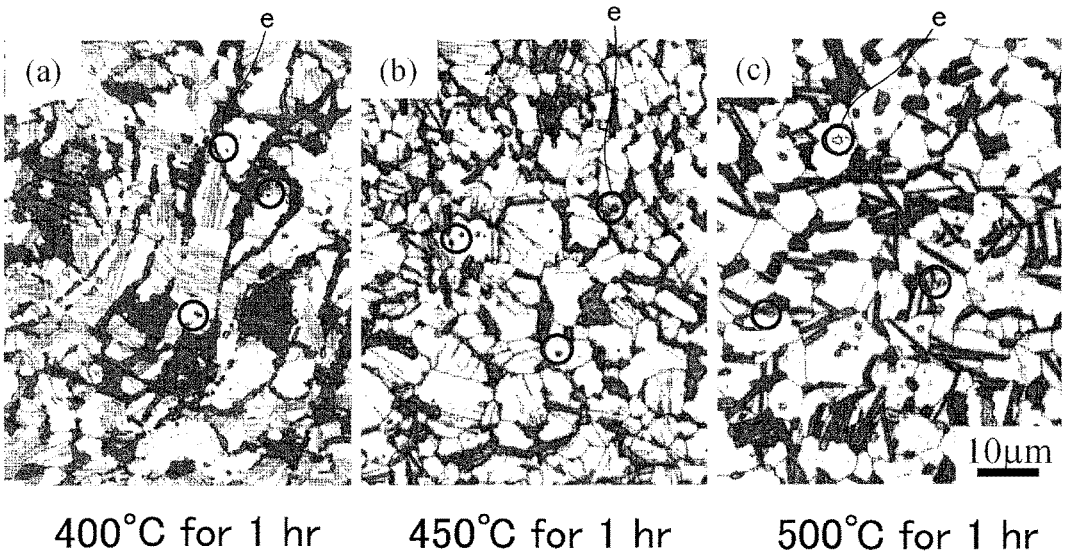
FIG. 3 is a micrograph for illustrating an intermetallic compound $Mg_{96}Zn_2Y_2$.

It is found that in a case where the $Mg_{96}Zn_2Y_2$ alloy is cast, the intermetallic compound $Mg_3Zn_3Y_2$ of approximately 0.5 μm to 2.0 μm is formed at a time of casting. It should be noted that. FIG. 3(*a*) is a scanning electron micrograph showing a crystalline structure of an annealed material of the $Mg_{96}Zn_2Y_2$ alloy at 400° C. for one hour, FIG. 3(*b*) is a scanning electron micrograph showing a crystalline structure of the annealed material of the $Mg_{96}Zn_2Y_2$ alloy at 450° C. for one hour, FIG. 3(*c*) is a scanning electron micrograph showing a crystalline structure of the annealed, material of the $Mg_{96}Zn_2Y_2$ alloy at 500° C. for one hear, and it is found that the intermetallic compound $Mg_3Zn_3Y_2$ is formed. It should be noted that the points indicated by reference signs e in the micrographs shown in FIGS. 3(*a*) to 3(*c*) indicate intermetallic compounds $Mg_3Zn_3Y_2$.

Next, a plastic working step S2 is performed on the cast material. Plastic working of this plastic working step S2 is, for example, extrusion, casting, rolling, drawing, or the like. In a plastically-worked item obtained, by performing plastic working on the cast material containing the LPSO phase, tensile strength, 0.2% yield strength, and elongation are improved in comparison to before plastic working.

Successively, by performing a heating step S3 of heating the plastically-worked item, the LPSO phase is formed in a sheet shape (plate shape). As one example, heating is performed within a temperature range of 400° C. or more and 500° C. or less and within a time range of 0.5 hours or more and 10 hours or less, for example.

It should be noted that the LPSO phase is formed in a sheet shape (plate shape) by the heating step S3. However, it is only necessary to form the LPSO phase in a sheet shape (plate shape) prior to a rolling step S4 described below in order to realize the crystalline structure shown in FIGS. 1A and 1B. Therefore, as long as the LPSO phase can be formed in a sheet shape (plate shape), the heating step S3 is not always required but any method may be used. Similarly, since it is only necessary to form the LPSO phase in a sheet shape (plate shape), the present invention is not limited to the temperature range and the time range exemplified above.

Thereafter, by performing the rolling S4 on the plastically-worked item heated so as to form the LPSO phase in a sheet shape (plate shape), the magnesium alloy sheet material of the present invention as shown in FIGS. 1A and 1B can be obtained.

Figure 4B:
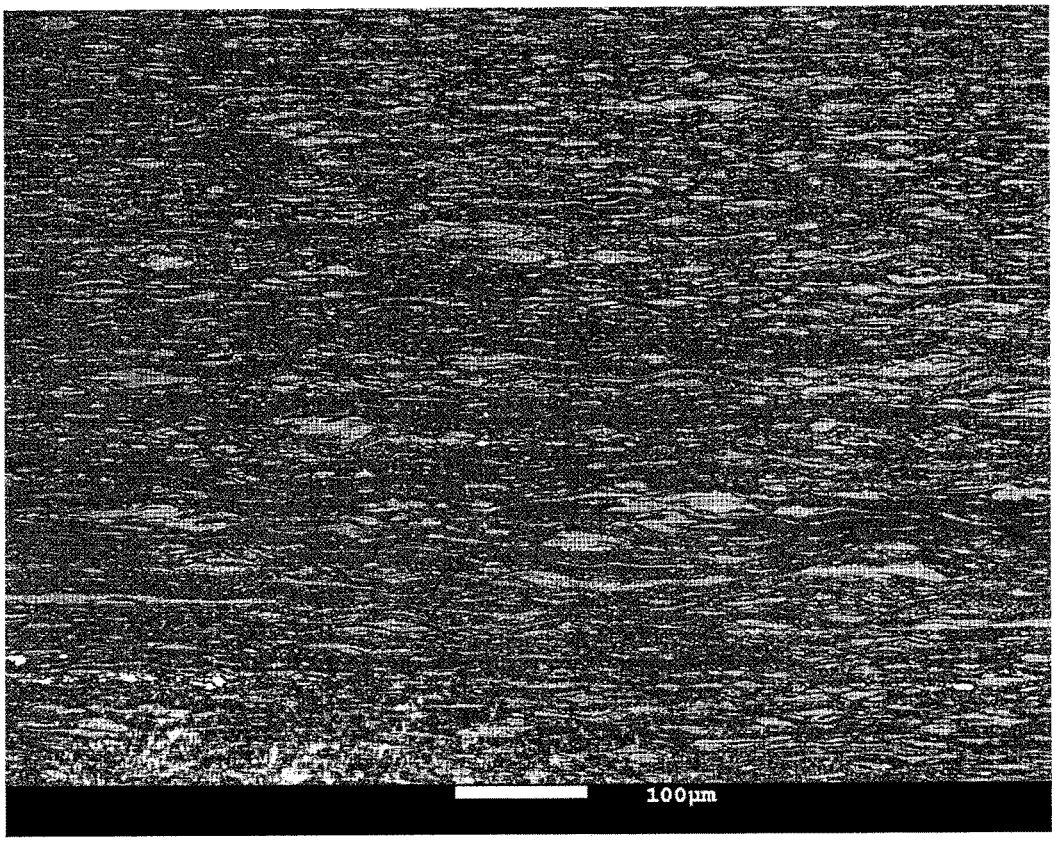
FIG. 4B(a) is a micrograph (2) showing the crystalline structure of the magnesium alloy material formed by performing the rolling S4 on the plastically-worked item to which no heating step is performed.
Figure 4B:
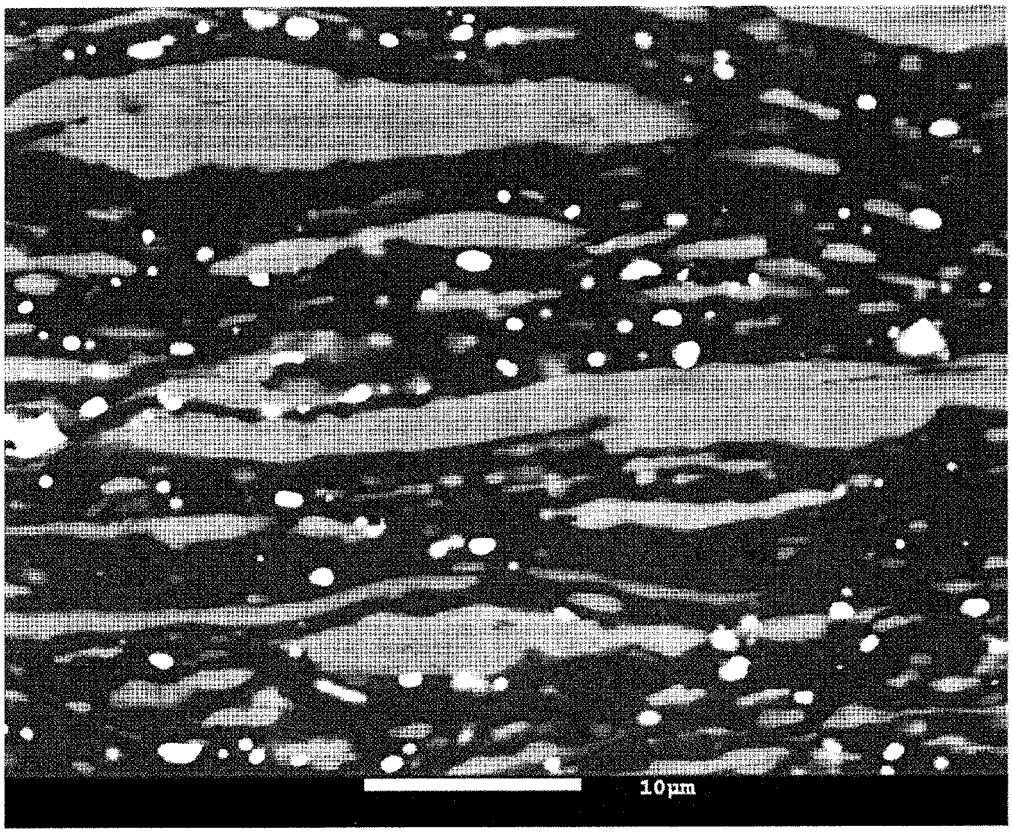
Figure 4B:
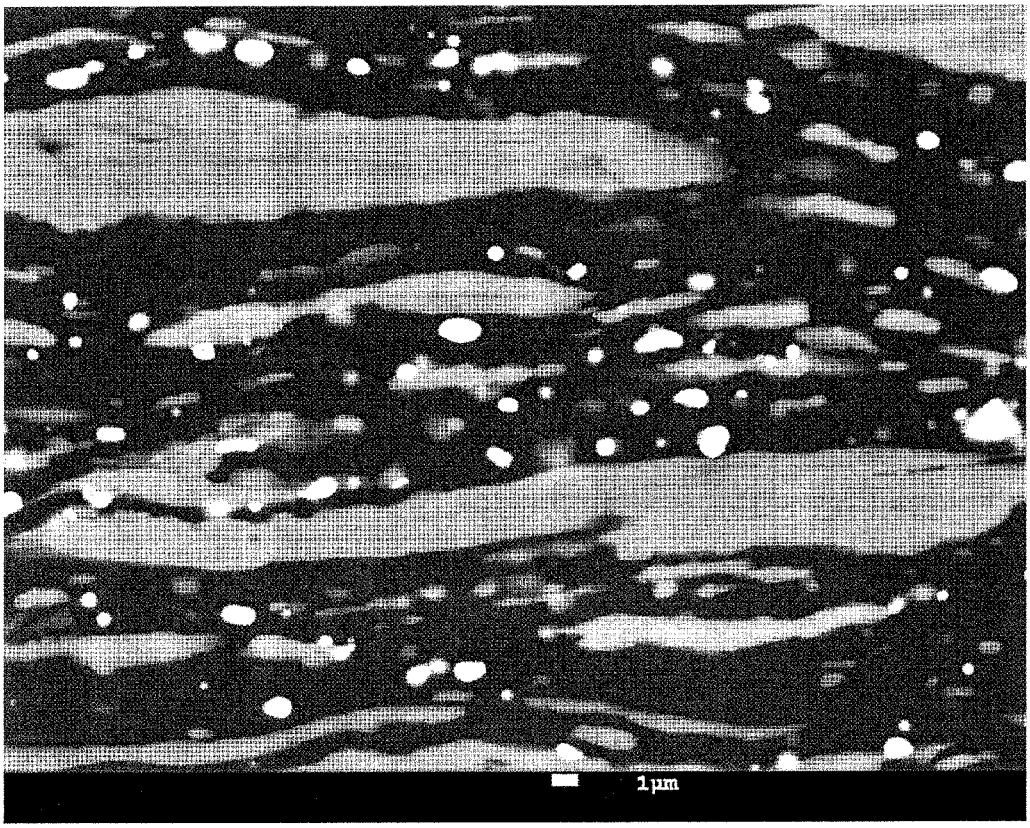

FIGS. 4A and 4B are micrographs showing a crystalline structure of the magnesium alloy sheet material formed by performing the rolling S4 on the plastically-worked item to which no heating step S3 is performed. In FIGS. 4A and 4B, the αMg phase is black, the LPSO phase is gray, and $Mg_3Zn_3Y_2$ is white.

As clear from FIGS. 4A and 4B, regarding the magnesium alloy sheet material formed by performing the rolling S4 on the plastically-worked item to which no heating step S3 is performed and in which the LPSO phase is not formed in a sheet shape (plate shape), the LPSO phase and the αMg phases are formed in a lamellar manner.

However, as clear from FIGS. 4A(b) and 4A(c), regarding the sheet-shape structure of the magnesium alloy material formed by performing the rolling S4 on the plastically-worked item to which no heating step S3 is performed and in which the LPSO phase is not formed in a sheet shape (plate shape), the LPSO phase is formed in a block shape, and the LPSO phase minutely spread in the αMg phases is extremely small. As clear from FIGS. 4B(b) and 4B(c), the LPSO phase is straight and no curved or bent part is found.

It should be noted that the manufacturing method of the magnesium alloy sheet material described above is only one example, and the magnesium alloy sheet material may be manufactured by various other manufacturing methods as a matter of course. The magnesium alloy of the present invention is not limited to the alloy obtained by the manufacturing method described above.

Example

Hereinafter, an example and a comparative example of the present invention will be described. It should be noted that the example shown below is only one example and does not limit the present invention.

Example

First, as a magnesium alloy sheet material of the example of the present invention, a Mg—Zn—Y alloy containing 2 atom % of Zn, 2 atom % of Y, and the remaining part including Mg and unavoidable impurities was melted in a high-frequency melting furnace. Next, the heated and melted material was cast, by a mold, so that an ingot (cast material) of φ69 mm×L200 mm was produced. Furthermore, plastic working (extrusion) was performed at an extrusion temperature of 350° C. at an extrusion ratio of 10, so that the ingot was made into a sheet form. Successively, one-hour heating (annealing) was performed at a heating temperature of 100° C. to 500° C., so that an LPSO phase was formed in a sheet shape (plate shape). Thereafter, rolling was performed, so that a test piece was produced.

Figure 5:
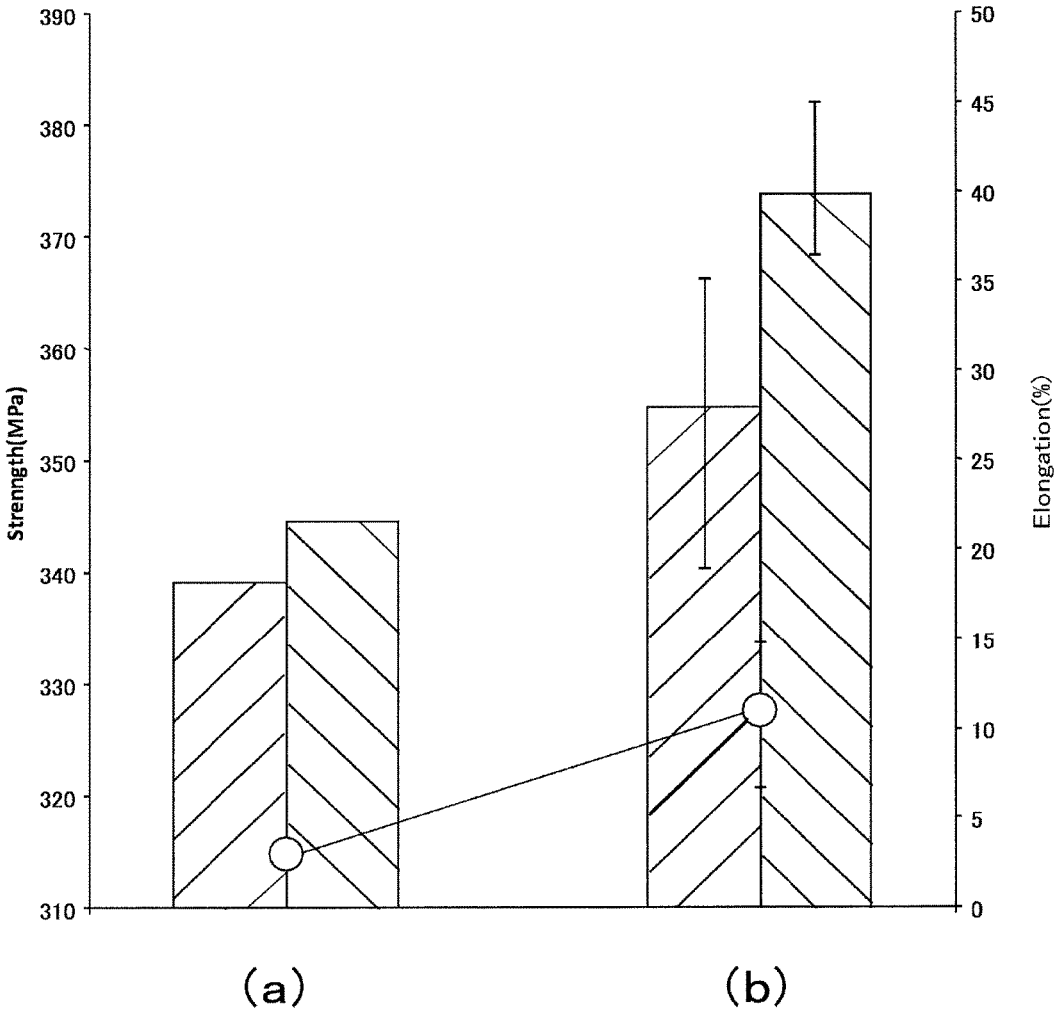
FIG. 5 is a graph showing 0.2% yield strength, tensile strength, and elongation of Example and Comparative Example.
Figure 8:
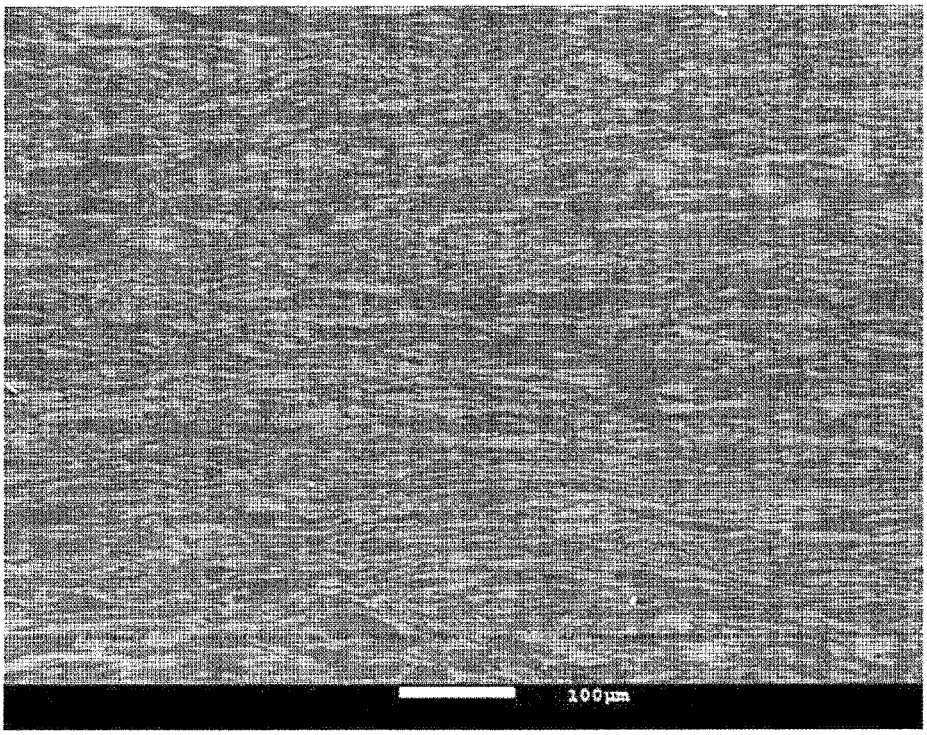
FIG. 8(*a*) is a micrograph (1) for illustrating one example of a sheet-shape structure.
Figure 8:
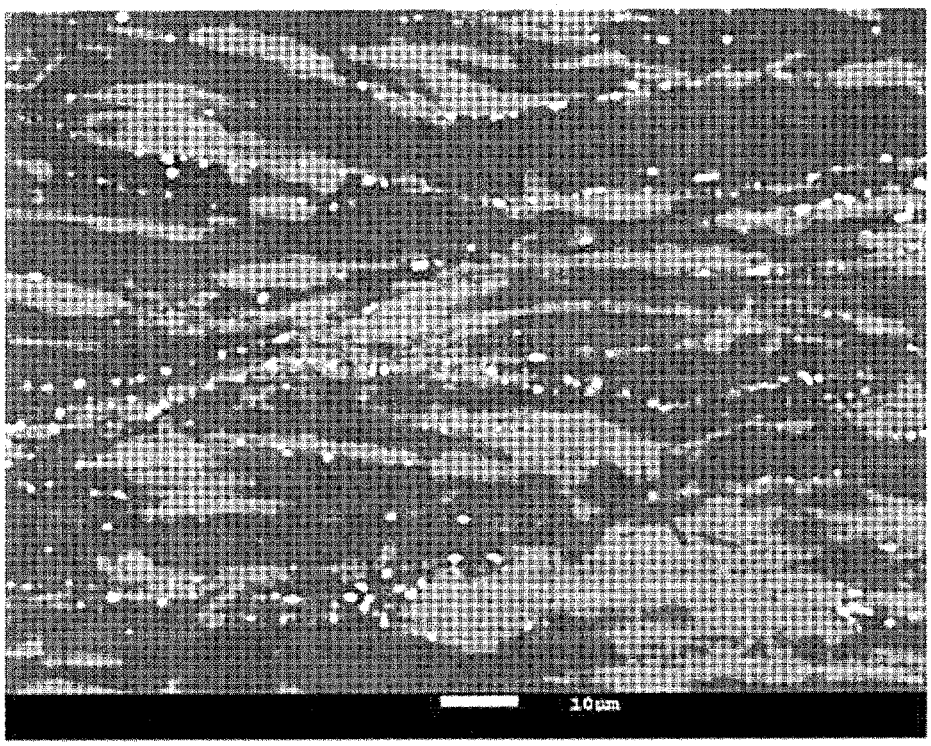
Figure 8:
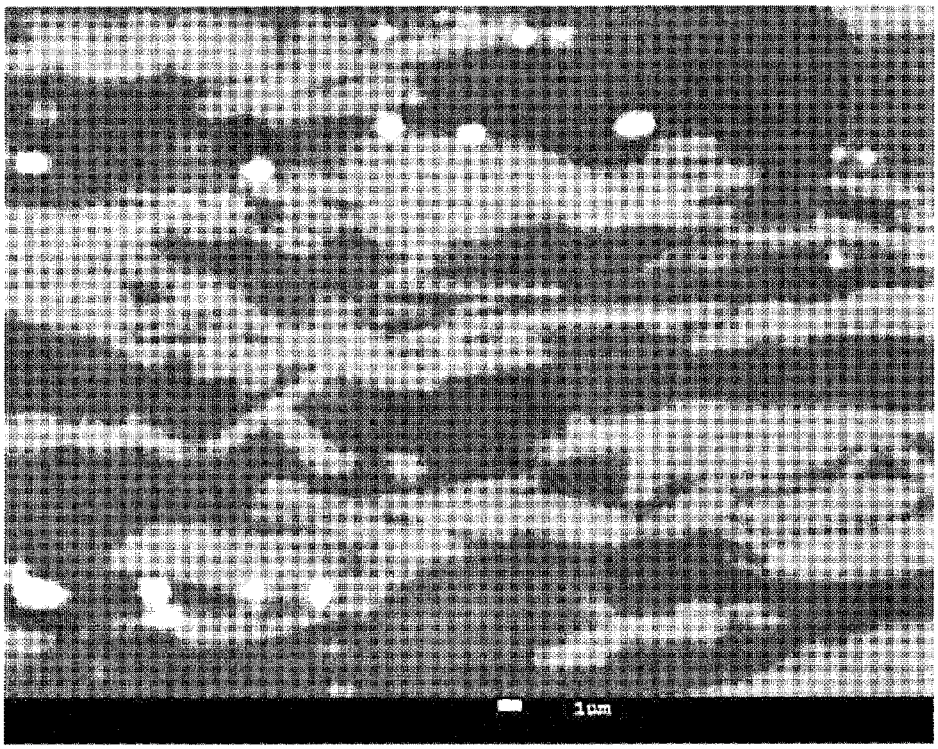

A result of a tensile test performed on the magnesium alloy sheet material obtained in such a way at a room temperature and an evaluation of mechanical properties is shown in FIG. 5(*b*). It should be noted than reference sign A in FIG. 5 indicates 0.2% yield strength, reference sign B in FIG. 5 indicates tensile strength, and reference sign C in FIG. 5 indicates ductility.

Comparative Example

Next, as a magnesium alloy sheet material of the comparative example, a Mg—Zn—Y alloy containing 2 atom % of Zn, 2 atom % of Y, and the remaining part including Mg and unavoidable impurities was melted in a high-frequency melting furnace. Next, the heated and melted material was cast by a mold, so that an ingot (cast material) of φ69 mm×L200 mm was produced. Furthermore, plastic working (extrusion) was performed at an extrusion temperature of 350° C. at an extrusion ratio of 10, so that the ingot was mace into a sheet form. Thereafter, without forming an LPSO phase in a sheet shape (plate shape), rolling was performed, so that a test piece was produced.

A result of a tensile test performed on the magnesium alloy sheet material obtained, in such a way at the room temperature and an evaluation of mechanical properties is shown in FIG. 5(*a*). It should be noted that reference sign A in FIG. 5 indicates 0.2% yield strength, reference sign B in FIG. 5 indicates tensile strength, and reference sign C in FIG. 5 indicates ductility.

As clear from FIG. 5, it is found that in the magnesium alloy sheet material of the example of the present invention, both 0.2% yield strength and tensile strength are improved in comparison to the magnesium alloy sheet material of the comparative example. It is found that ductility is also improved. That is, with the magnesium alloy sheet material of the example of the present invention, tensile strength and ductility are improved at the same time without changing an alloy composition in the magnesium alloy sheet material containing the LPSO phase.

The invention claimed is:

1. A manufacturing method of a magnesium alloy sheet material comprising the steps of:

forming a cast material by casting a dissolved magnesium alloy, wherein the cast material formed comprises a long period stacking order phase crystallized during said casting and a plurality of α-magnesium phases;

after forming said cast material, plastic working said cast material to form a magnesium alloy sheet material having an improved tensile strength and elongation capability relative to the cast material prior to extrusion, and wherein said long period stacking order phase has a first shape;

after said plastic working, performing a heat treatment to said magnesium alloy sheet material to spread out the long period stacking order phase into a sheet shape; and after said heat treatment that spreads the long period stacking order phase, rolling said magnesium alloy sheet material to either one or both of shear-deform or compression-deform the long period stacking order phase and thereby introduce a kink deformation into the long period stacking order phase which further improves tensile strength and ductility of the magnesium alloy sheet material;

wherein, after rolling, said magnesium alloy sheet material comprises:

in a case where a sheet-thickness traverse section of an alloy structure is observed at a substantially right angle to the longitudinal direction by a scanning electromicroscope, a structure mainly composed of said long period stacking order phase, in which at least two or more of said αMg phases having thickness in the observed section of 0.5 μm or less are laminated in a layered manner with said long period stacking order phase of the sheet shape, and wherein said magnesium alloy sheet material comprises 2 atomic % of Zn, 2 atomic % of Y, and the remaining part including Mg and unavoidable impurities.

2. The manufacturing method of the magnesium alloy sheet material according to claim 1, wherein said heat treatment is performed within a temperature range of 400° C. or more and 500° C. or less and within a time range of 0.5 hours or more and 10 hours or less.

3. The manufacturing method of the magnesium alloy sheet material according to claim 1, wherein said long period stacking order phase in the laminated structure has maximum thickness in the observed section of 9 μm or less.

4. The manufacturing method of the magnesium alloy sheet material according to claim 1, wherein in the laminated structure, said long period stacking order phase of the sheet shape and said αMg phases having smaller-thickness in the observed section than said long period stacking order phase are laminated in a layered manner.

5. The manufacturing method of the magnesium alloy sheet material according to claim 1, wherein said long period stacking order phase of the sheet shape in the laminated structure has minimum thickness in the observed section of 0.25 μm or more.

6. The manufacturing method of the magnesium alloy sheet material according to claim 1, wherein the laminated structure includes an intermetallic compound.

7. The manufacturing method of the magnesium alloy sheet material according to claim 1, wherein at least part of the laminated structure is shear-deformed or compression-deformed.

8. The manufacturing method of the magnesium alloy sheet material according to claim 1, wherein at least part of the laminated structure is curved or bent.

9. The manufacturing method of the magnesium alloy sheet material according to claim 1, wherein the laminated structure includes $Mg_3Zn_3Y_2$, the $Mg_3Zn_3Y_2$ is spread in said long period stacking order phase or said αMg phases.

10. The manufacturing method of the magnesium alloy sheet material according to claim 1, wherein said further improvement of tensile strength and ductility of the magnesium alloy sheet material during the rolling step comprises at least a 5% improvement in ductility.

11. The manufacturing method of the magnesium alloy sheet material according to claim 1, wherein said further improvement of tensile strength and ductility of the magnesium alloy sheet material during the rolling step comprises at least a 10% improvement in ductility.

* * * * *